United States Patent [19]

Riley et al.

[11] Patent Number: 4,525,090

[45] Date of Patent: Jun. 25, 1985

[54] LIQUID DISPENSING BOTTLES WITH BUILT-IN APPLICATORS

[76] Inventors: Patrice J. Riley, 25038 Fourl Rd., Newhall, Calif. 91321; Arthur W. Riley, 13218 Herrick Ave., Sylmar, Calif. 91342

[21] Appl. No.: 538,222

[22] Filed: Oct. 3, 1983

[51] Int. Cl.[3] ..... A46B 11/00; A45D 29/20; A45D 44/18

[52] U.S. Cl. ..... 401/127; 401/129; 132/75; 132/85; 132/88.7

[58] Field of Search ..... 132/73, 73.5, 74.5, 132/75, 76.2, 84 R, 88.7; 401/123, 127, 129, 128; 15/167 R, 167 B; 141/24

[56] References Cited

U.S. PATENT DOCUMENTS

| | | | |
|---|---|---|---|
| 988,544 | 4/1911 | Bradford | 401/127 |
| 2,138,319 | 11/1938 | Bilbrey | 401/127 |
| 2,334,531 | 11/1943 | Apfelbaum | 401/128 |
| 2,517,663 | 8/1950 | Hendry et al. | 401/127 |
| 2,538,447 | 1/1951 | Finney | 401/127 |
| 2,644,183 | 7/1953 | Kellett | 132/84 R |
| 2,756,749 | 7/1956 | Munday | 141/24 |
| 2,913,017 | 11/1959 | Robineau | 141/24 |
| 3,157,905 | 11/1964 | Levy | 401/123 |
| 3,292,202 | 12/1966 | Cochran | 15/167 B |
| 3,337,901 | 8/1967 | Schefer et al. | 132/74.5 |
| 4,313,686 | 2/1982 | Proffer | 401/127 |
| 4,376,591 | 3/1983 | Proffer | 401/127 |

*Primary Examiner*—Richard J. Apley
*Assistant Examiner*—Carolyn A. Harrison
*Attorney, Agent, or Firm*—Gerald L. Price

[57] ABSTRACT

A liquid dispensing bottle for containing liquids having a cap thereon for sealing the contents of the bottle. An applicator is carried on the cap extending into contact with liquids at the bottom of the bottle when the cap is sealed to the bottle. When the cap is unsealed from the bottle, the applicator, carried by the cap, is now above the liquid contents at the bottom of the bottle. The applicator is reciprocal in the cap and movable axially therealong to engage any liquids at the bottom of the bottle without the need for either tilting the bottle or re-sealing the cap back onto the bottle.

8 Claims, 5 Drawing Figures

LIQUID DISPENSING BOTTLES WITH BUILT-IN APPLICATORS

BACKGROUND OF THE INVENTION

1. Field of the Invention

The invention relates to liquid dispensing bottles; and, more particularly, to such bottles having an integral applicator as a brush or dropper for removing liquids therefrom.

2. Description of the Prior Art

Bottles having built-in brushes or the like for removing or dispensing liquids or other fluids therefrom, such as fingernail polish, are well known in the art. In such prior art bottles, a cap is usually threaded onto the neck of the bottle and contains a sub-assembly serving as a seal when the cap is thre aded tightly on the bottle and also containing a brush or liquid removing tube or dropper extending into the bottle. The latter extends into contact with the liquid in the bottle and is used to both remove the liquid therefrom and serve as an applicator. In actual use, the cap is merely placed on the bottle and not threaded down to the sealing point. Obviously, then, the applicator does not go all the way down into the bottle and it is necessary to tilt the bottle to get at the contents (at least, contents at any point below the extent of the applicator into the bottle when the cap is unscrewed therefrom). The applicator cannot always remove all the contents even when the bottle is tilted and the fluid not reached by the applicator is discarded. The quantity of such waste can be as high as 30%. It is time consuming to screw the cap down each time to reach the liquid and, normally, two hands are necessary. Thus, it is not usually done in either domestic or commercial use.

In U.S. Pat. No. 2,756,749 to Munday, a fluid dispenser is provided having a flexible diaphragm to permit motion of the applicator in all directions to get at the fluid in the bottom of the container; however, leakage between the cap and bottle might take place in such an arrangement. Similar flexible diaphragms are provided in the dispensers of Hendry et al in U.S. Pat. No. 2,517,663 and Robineau in U.S. Pat. No. 2,913,017. Such diaphragms are expensive to manufacture and may clog in use.

There is a need for a dispensing bottle whereby little if any liquids are wasted and substantially all liquid can be quickly and easily removed.

SUMMARY OF THE INVENTION

It is an object of this invention to provide a liquid dispensing bottle whereby the contents at the bottom of the bottle can be accessed without tilting the bottle or screwing or otherwise resealing the cap back on the bottle.

It is a further object of this invention to access such liquid contents while the cap of the bottle is unscrewed from the neck of the bottle.

These and other objects are preferably accomplished by providing a liquid dispensing bottle having a cap thereon for sealing the bottle. An applicator is carried by the cap extending into contact with liquids at the bottom of the bottle when the cap is sealed to the bottle. When the cap is unsealed from the bottle, the applicator, carried by the cap, is now above the liquid contents at the bottom of the bottle. The applicator is reciprocal in the cap and movable axially therein to engage any liquids at the bottom of the bottle without the need for either tilting the bottle or re-sealing the cap back onto the bottle.

DESCRIPTION OF THE PREFERRED EMBODIMENT

Figure 1:
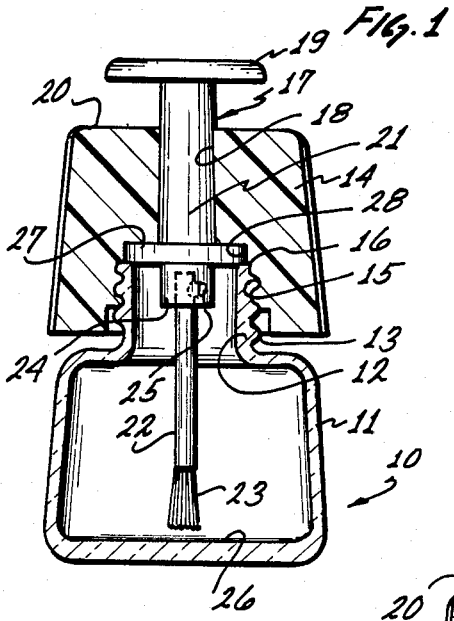
FIG. 1 is a vertical cross-sectional view of the liquid dispenser of the invention showing the cap screwed onto the neck of the bottle.

Referring now to FIG. 1 of the drawing, a dispensing device 10 is shown comprising a bottle or other liquid holding container 11. The bottle 11 includes a restricted neck opening 12 having a threaded exterior section 13 for receiving a cap 14 thereon. Cap 14 is of any convenient shape and includes a like threaded interior section 15 for engaging threaded section 13 of bottle 11. In this manner, cap 14 can be quickly and easily threaded onto the neck of bottle 11. A shoulder or stop 16 is provided on the interior of cap 14 as shown for limiting downward movement of cap 14.

As particularly contemplated in the present invention, a plunger 17 is slidably mounted in an axially extending passageway 18 extending through cap 14. Plunger 17 includes a top portion 19, which may be disk-shaped, overlying the top 20 of cap 14 and preferably of a greater diameter than passageway 18. An integral post 21 extends downwardly from top 19 and is preferably of an outer diameter related to the diameter of passageway 18 so that it is movable or slidable within the passageway 18. Although both post 21 and passageway 18 may be generally circular in cross-section, or tapered therealong, they may be of any suitable mating configuration. However, both post 21 and passageway 18 should be of generally similar configuration so that post 21 slides in passageway 18 but fluids or liquids in the lower part of bottle 11 cannot easily leak out. Thus, there is preferably a friction-fit between passageway 18 and post 21.

Plunger 17 carries a brush holder 22 at its lower end having brush bristles 23. The holder 22 is insertible into a socket 24 in the lower end of plunger 17 and may be permanently mounted therein or removable therefrom, as set screw 25 indicates which screw 25 extends through the lower end of the plunger 17 into socket 24 to hold brush holder 22 securely therein while permitting easy removal.

As can be seen in FIG. 1, and as will be explained more fully hereinbelow, the lowermost end of brush bristles 23 terminate at the bottom 26 of bottle 11. This is the normal position of bristles 23 when cap 14 is screwed into closed position as shown in FIG. 1.

An enlarged plunger section 27 is provided between socket 24 and the top 19 of plunger 17. The exact location would of course be dependent upon the size of the various components. Such section 27 is of an outer diameter, however, greater than the inner diameter of neck 12 so that it overlies, and is adapted, in the position in FIG. 1, to rest on the top of the threaded neck 12 of bottle 11. This section 27 rests in an annular cavity or groove 28 formed in cap 14 above its threaded section 15, as shown.

Figure 2:
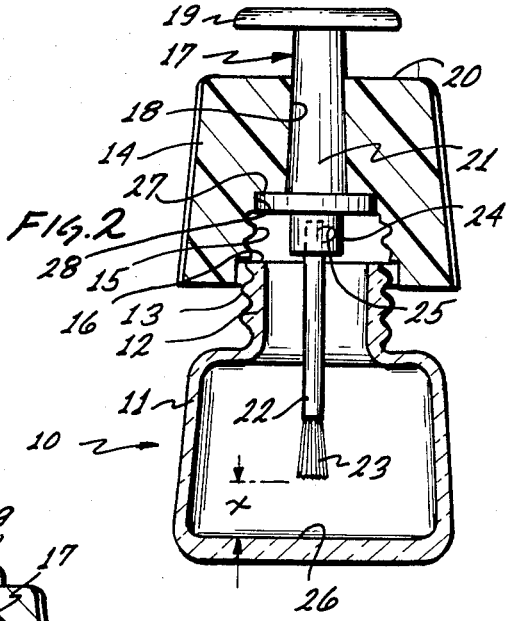
FIG. 2 is a vertical cross-sectional view of the device of FIG. 1 showing the cap in unscrewed position.

When cap 14 is unscrewed, from neck 12, as shown in FIG. 2, it can be seen that the lowermost end of brush bristles 23 is spaced a distance x from the bottom 26 of bottle 11. If one wished to get at any liquid in bottle 11, within the area x, it would be necessary to remove the cap 14, *along with plunger* 17, *and tilt the bottle* 11. Alternatively, one would have to screw the cap 14 back into tight-fitting engagement with the neck 12 of bottle 11 which is timeconsuming.

Figure 3:
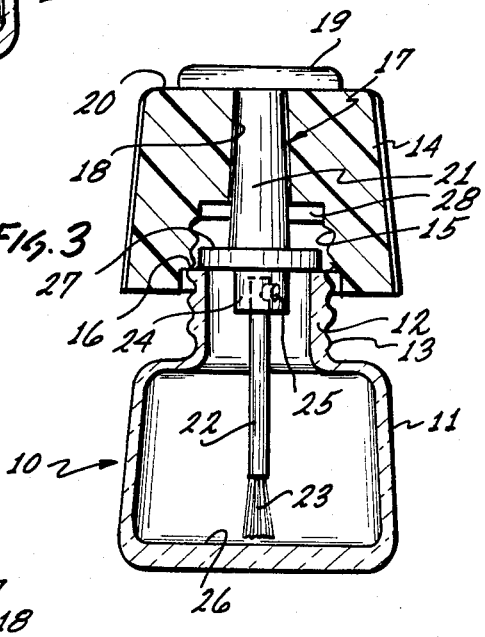
FIG. 3 is a vertical cross-sectional view of the device of FIGS. 1 and 2 showing the brush extended into contact with the bottom of the bottle.

Thus, as particularly contemplated in the invention, as shown in FIG. 3, pushing down on top 19 of plunger 17 moves plunger section 27 away from annular groove 28 until it abuts against the top of threaded neck 12. At this point, bristles 23 reach to the bottom 26 of bottle 11 and thus provide access to any liquids therein without the necessity of tilting bottle 11 or screwing cap 14.

Figure 4:
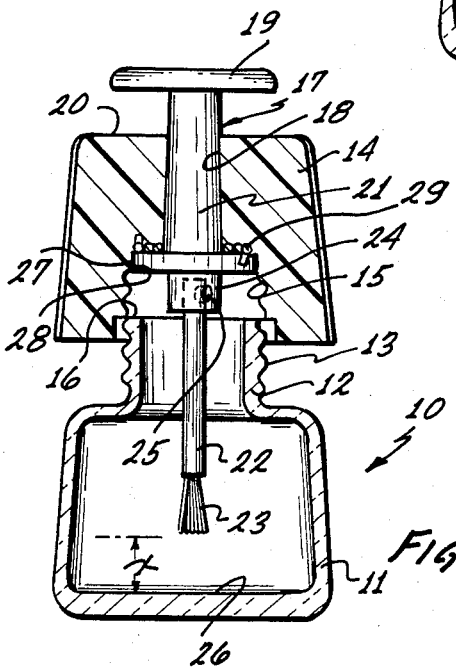
FIG. 4 is a view similar to FIG. 2 showing a coil spring added thereto.

Although plunger 17 can quickly and easily slide within passageway 18, it may be desirable to make plunger 17 spring-biased. Thus, as shown in FIG. 4, a coil spring 29, secured to section 27 and groove 28 and normally biasing the same into engagement, may be provided in cavity or groove 28 encircling plunger 21 above section 27. As the plunger is pushed to the FIG. 3 position, as heretofore described, spring 29 would return the plunger 21 to the FIG. 4 position.

Figure 5:
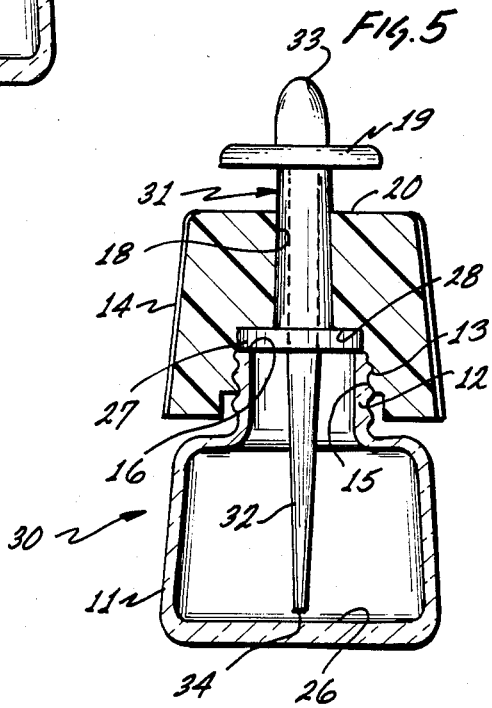
FIG. 5 is a vertical cross-sectional view, similar to FIG. 1, showing a modification thereof.

Although a brush arrangement has been heretofore disclosed, as seen in FIG. 5, a dispenser 30 is shown wherein like numerals refer to like parts of the embodiment of FIGS. 1 to 3. Thus, instead of plunger 17 holding a brush, a plunger 31 is provided again having a stop or top 19 but also including a tube or dropper 32, such as an eye dropper, extending axially through plunger 31 terminating at the top in a resilient squeezable cap 33 and at the bottom in an opening 34 communicating with both the interior of drooper 32 and cap 33 whereby, as is known in the dropper art, cap 33 may be squeezed to lift and remove liquid into bottle 11 into and through opening 34 for retention in tube 32. It can be understood that, when cap 14 in FIG. 5 is unscrewed as heretofore described with respect to FIG. 2, the opening 34 is moved to the same position as bristles 23 in FIG. 2. Pushing down on top 19 in FIG. 5 thus would move tube 32 downwardly until opening 34 therein is adjacent bottom 26 as described heretofore with respect to FIG. 3. It is believed that this is obvious in FIG. 5 and no further illustration is deemed necessary. Also, a spring 29, as heretofore described in FIG. 4, may be provided in the FIG. 5 embodiment, if desired.

It can be seen that there is described a new dispenser for quickly and easily reaching fluid remaining in a bottle or the like with a brush, dropper or dauber. The dispensers herein may be of any suitable materials, such as a rubber cap 33, plastic or glass tube 32, metal, glass or plastic bottle 11 and cap 14, etc.

It can also be seen that the invention disclosed herein solves the waste of time and liquid material encountered in the past. The plunger is axially movable a distance substantially the same as the threaded engagement length of the cap to the bottle. That is, as seen in FIG. 1 and FIG. 5, the lowermost end of the plungers therein terminate very near the bottom of the bottle when the caps are screwed on tightly. When the caps on the bottles in FIGS. 1 and 5 are removed or unscrewed and placed on the bottle (as in FIG. 2) and thus not screwed to the sealing point, the applicator brush bristles 23 or dropper 32, for example, may be pushed into the bottle to the depth of the bottle as if the cap was screwed on tightly. Thus, a nearly complete consumption of the bottle contents is obtained in a quick and inexpensive manner without either screwing the cap on and off or tipping the bottle. The savings in commercial use of such a device could be as high as 30% more, or better, in utilization of the liquids in such bottles and 50% or more in man-hours. No complicated sealing procedure is needed and the cap is merely screwed on as is known in prior art bottles, with sealing of the contents therein carried out in a conventional manner.

Although a brush or squeeze-type dropper has been disclosed, obviously any suitable applicator may be used, such as a straight-pin type applicator, as used for iodine or thimerosal, or a dauber, etc. In any case, such plunger or applicator may frictionally fit in the passageway through the cap so it is carried upwardly with the cap when the cap is unsealed or unscrewed from the bottle, then movable down into the bottle as heretofore described.

Any suitable materials may be used and liquid seals may be provided between the cap and the bottle as is well known in the art.

Although the cap is disclosed as "threaded" onto the neck of the bottle, obviously all suitable sealing means between an open container and a closure member therefor are considered as coming within the scope of the invention.

I claim:

1: In a liquid dispenser including a container for liquids and a sealing member for sealing the contents of the container, the sealing member having a built-in applicator for accessing any liquids in the container normally extending into the container when said sealing member seals the contents of the container, the improvement which comprises:

said sealing member is a cap screwed onto said container and said applicator is reciprocally mounted within said cap and axially movable therealong whereby, when said cap is in an unsealing position with respect to said container, said applicator may be reciprocated within said cap to extend back into substantially its position with respect to said container when said cap is in a sealed position with respect to said container without resealing of said container by said cap, said container being a bottle having a threaded neck and said cap including internal threads adapted to engage the threaded neck of said bottle in sealing engagement, said cap including an internal annular shoulder of a diameter greater than that of the inner diameter of said neck, said applicator including a liquid applicating portion at its lower end in said bottle and a stop member at its uppermost end extending outside of said bottle, and an intermediate section on said applicator conforming substantially to said annular shoulder and engaging the same when said cap is threaded to said bottle, said intermediate section being of an overall diameter greater than the internal diameter of said neck.

2. In In the dispenser of claim 1 wherein said liquid applicating portion is a brush.

3. In the dispenser of claim 1 wherein said liquid applicating portion is a dropper.

4. In the dispenser of claim 1 wherein resilient means is disposed between said annular shoulder and said intermediate section normally biasing said intermediate section into engagement with said annular shoulder.

5. A dispenser for dispensing liquid comprising:

a bottle having a threaded neck;

a cap threaded on said neck, said cap having an axially extending passageway therethrough, said passageway forming an annular shoulder with said cap on the inner wall thereof above the threaded portion of said cap;

a liquid dispensing applicator slidably and reciprocally mounted in said passageway, said applicator having a main body portion disposed in said passageway along said cap, an integral top portion extending out of said cap, and an integral bottom liquid applicator portion extending downwardly from said main body portion into the interior of said bottle terminating substantially at the bottom of said bottle when said cap is threaded onto the neck of said bottle whereby, when said cap is unthreaded from said neck, said bottom applicator portion is raised upwardly within said bottle and, pushing on said top portion reciprocates said applicator thereby extending said applicator portion back into its original position substantially at the bottom of the bottle; and limiting means on both the main body portion of said applicator and said cap for limiting the upward movement of said applicator, said limiting means including a stop member integral with said main body portion of said applicator below said top portion and above said bottom applicator portion and a shoulder in the inner wall of said cap engaged by said stop member when said cap is threaded onto said neck.

6. In the dispenser of claim 5 wherein both said stop member and said shoulder are greater in diameter than the inner diameter of said neck, said stop member resting on the top of said neck when said cap is threaded thereon.

7. In the dispenser of claim 5 wherein the overall length of said threads on said neck and said cap is substantially the same as the overall length of said applicator portion.

8. In the dispenser of claim 5 wherein said top portion is a stop member greater in outer diameter than the internal diameter of said passageway.

* * * * *